US012215559B2

(12) United States Patent
Head

(10) Patent No.: US 12,215,559 B2
(45) Date of Patent: Feb. 4, 2025

(54) THERMITE METHOD OF ABANDONING A WELL

(71) Applicant: PSP-IP Limited, Newcastle upon Tyne (GB)

(72) Inventor: Philip Head, Berkshire (GB)

(73) Assignee: PSP-IP Limited, Newcastle Upon Tyne (GB)

( * ) Notice: Subject to any disclaimer, the term of this patent is extended or adjusted under 35 U.S.C. 154(b) by 0 days.

(21) Appl. No.: 18/009,465

(22) PCT Filed: Jun. 9, 2021

(86) PCT No.: PCT/GB2021/051431
§ 371 (c)(1),
(2) Date: Dec. 9, 2022

(87) PCT Pub. No.: WO2021/250401
PCT Pub. Date: Dec. 16, 2021

(65) Prior Publication Data

US 2023/0220740 A1 Jul. 13, 2023

(30) Foreign Application Priority Data

Jun. 9, 2020 (GB) ..... 2008656
Jun. 9, 2020 (GB) ..... 2008658
Jul. 31, 2020 (GB) ..... 2011982

(51) Int. Cl.
*E21B 29/02* (2006.01)
*E21B 23/04* (2006.01)
*E21B 41/00* (2006.01)

(52) U.S. Cl.
CPC ..... *E21B 29/02* (2013.01); *E21B 23/0417* (2020.05); *E21B 41/0078* (2013.01)

(58) Field of Classification Search
CPC ..... E21B 29/02; E21B 31/16; E21B 23/0417; E21B 41/0078
See application file for complete search history.

(56) References Cited

U.S. PATENT DOCUMENTS 4,619,318 A 10/1986 Terrell et al.
4,963,203 A * 10/1990 Halcomb ..... C06B 33/00 199/36
5,343,963 A * 9/1994 Bouldin ..... E21B 23/042 175/38

(Continued)

FOREIGN PATENT DOCUMENTS

CN 1284750 C 11/2006
WO 2016069305 A1 5/2016

OTHER PUBLICATIONS

International Search Report and Written Opinion of International Application No. PCT/GB2021/051431 Dated Nov. 8, 2021, 16 pages.

*Primary Examiner* — D. Andrews
*Assistant Examiner* — Ronald R Runyan
(74) *Attorney, Agent, or Firm* — Lippes Mathias LLP

(57) ABSTRACT

A well cutting tool, comprising a housing including a chamber, the housing having at least one nozzle, the chamber being loaded with thermite, and a gas-generating additive an ignitor such that when the ignitor is actuated to ignite the thermite, the gas-generating additive is caused to create an increase in pressure which discharges energised molten thermite from the chamber and out of the housing through the at least one nozzle.

17 Claims, 12 Drawing Sheets

(56) References Cited

U.S. PATENT DOCUMENTS

| | | | | |
|---|---|---|---|---|
| 10,781,676 | B2 * | 9/2020 | Huang | E21B 43/114 |
| 2009/0194277 | A1 * | 8/2009 | Burnett | E21B 43/122<br>166/55.1 |
| 2017/0335646 | A1 * | 11/2017 | Huang | E21B 43/11 |
| 2022/0260353 | A1 * | 8/2022 | Yates | F42C 19/0803 |
| 2023/0340857 | A1 * | 10/2023 | Head | E21B 33/1208 |

* cited by examiner

Section LL

Section BB

Section CC

Section DD

Section EE

Section FF

Section GG

Closed

Open

THERMITE METHOD OF ABANDONING A WELL

Over the past 20 years or so a large number of offshore structures have been constructed which are now or will soon be exhausted and will need to be abandoned. These offshore structures may comprise production platforms which are either steel or concrete structures resting on the sea bed or floating platforms. Numerous conduits are connected to these offshore structures to carry the various fluids being gas, oil or water etc., which are necessary for the production of oil and/or gas from the well.

In abandoning a well, consideration has to be given to the potential environmental threat from the abandoned well for many years in the future.

In the case of offshore structure there is usually no rig derrick in place which can be used to perform the required well abandonment procedure. Therefore it is typically necessary to install a new derrick or alternatively a mobile derrick can be positioned above the well. This requirement adds considerable expense to the task of abandoning the offshore well, compared to a land based well.

A typical production well will comprise a number of tubular conduits arranged concentrically with respect to each. The method of abandoning the well which is presently known in the art involves the separate sealing of each of the concentric conduits which requires a large number of sequential steps.

In the abandonment method known in the art the first step is to seal the first central conduit usually by means of cement or other suitable sealant. The first annular channel between the first and second conduits is then sealed and the first central conduit is then cut above the seal and the cut section is removed from the well.

The second annular channel between the second and third conduits is then sealed and the second conduit cut above the seal and the cut section is removed from the well.

This process is repeated until all the conduits are removed. The number of separate steps required is typically very large indeed and the number of separate operations is five times the number of conduits to be removed. This adds considerably to the cost of the well abandonment due to the time taken and the resources required at the well head.

It is the purpose of the present invention to provide a method of abandoning a well which avoids the disadvantageous and numerous operations which are required by the existing known methods. This will greatly reduce the costs of safely abandoning a well. It is a further objective of the invention to provide a method of abandoning a well without the requirement of a rig which involves significant expense particularly in subsea based wells.

It is a further advantage of the invention to sever the tubing inside the well to get access to outside the tubing.

According to the present invention there is provided a method of abandoning a well, by using a tool loaded with thermite and gas generating additive such as covalent carbides, such as silicon carbide and boron carbide, but may also include interstitial carbides, such as titanium carbide and vanadium carbide.

According to another aspect of the present invention the ignitor is electrically based and initiates a thermal ignitor when it receives a coded acoustic signal from a transmitting tool According to another aspect of the present invention the ignitor is electrically based and initiates a thermal ignitor when it receives an instruction on the conveyed wireline According to another aspect of the present invention the discharge nozzles form a shape so as to focus the plasma jet in a thin controlled 360 degree dispersion According to another aspect of the invention, the nozzle faces can be adjusted to open to different widths depending upon the thickness of the tubing to be severed.

According to another aspect of the invention, the discharge could be covered by heat shrink According to another aspect of the invention, the discharge ports could be sealed with bismuth, which melts allows the plasma to flow out of the nozzle According to another aspect of the invention, could be sealed by a water proof tape, which tears open when the thermite is ignited According to a further aspect of the invention the ignitor could include a secondary back up such as a hydrostatic pressure switch According to a further aspect of the invention the ignitor could include a secondary low temperature alloy part which has to melt to operate a switch According to a further aspect of the invention the thermite composition for producing high-pressure, high-velocity gases, consisting essentially of (a) an oxidizable metal; (b) an oxidizing reagent; (c) a high-temperature-stable gas-producing additive selected from the group consisting of metal carbides and metal nitrides.

According to the present invention there is provided a method of abandoning a well, by using a tool loaded with thermite and gas generating additive such as covalent carbides, such as silicon carbide and boron carbide, but may also include interstitial carbides, such as titanium carbide and vanadium carbide.

According to a further aspect of the invention, a volume of glycol, in a hermetically sealed container is inside the thermite chamber, when the thermite is heated, it converts the glycol to a highly energised state which results in a highly energised plasma jet.

According to a further aspect of the invention, a volume of glycerine, in a hermetically sealed container is inside the thermite chamber, when the thermite is heated, it converts the glycerine to a highly energised state which results in a highly energised plasma jet.

According to a further aspect of the invention, a volume of water, in a hermetically sealed container is inside the thermite chamber, when the thermite is heated, it converts the water to a highly energised state which results in a highly energised plasma jet.

According to another aspect of the present invention the discharge nozzles separate to form a shape so as to focus the plasma jet in a thin controlled 360 degree dispersion and inclined at an angle 45 degrees to the axis of the tubing According to a further aspect of the invention nozzle could have more than one exit nozzle to produce multiple perforations According to a further aspect of the invention, the nozzle exit could be part of a spacer to separate to nozzle rings.

According to a further aspect of the invention, the spacer can have a shape to focus the plasma discharge According to a further aspect of the invention the discharge nozzle would be a single piece component made from tungsten carbide According to a further aspect of the invention the discharge nozzle would consist of two solid tungsten carbide rings, which when separated generate a uniform 360 degree plasma jet Thus by means of the method according to the invention a extremely safe means of activating a thermite reaction in a well is achieved.

The following is a more detailed description of an embodiment according to invention by reference to the following drawings in which.

Figure 8:
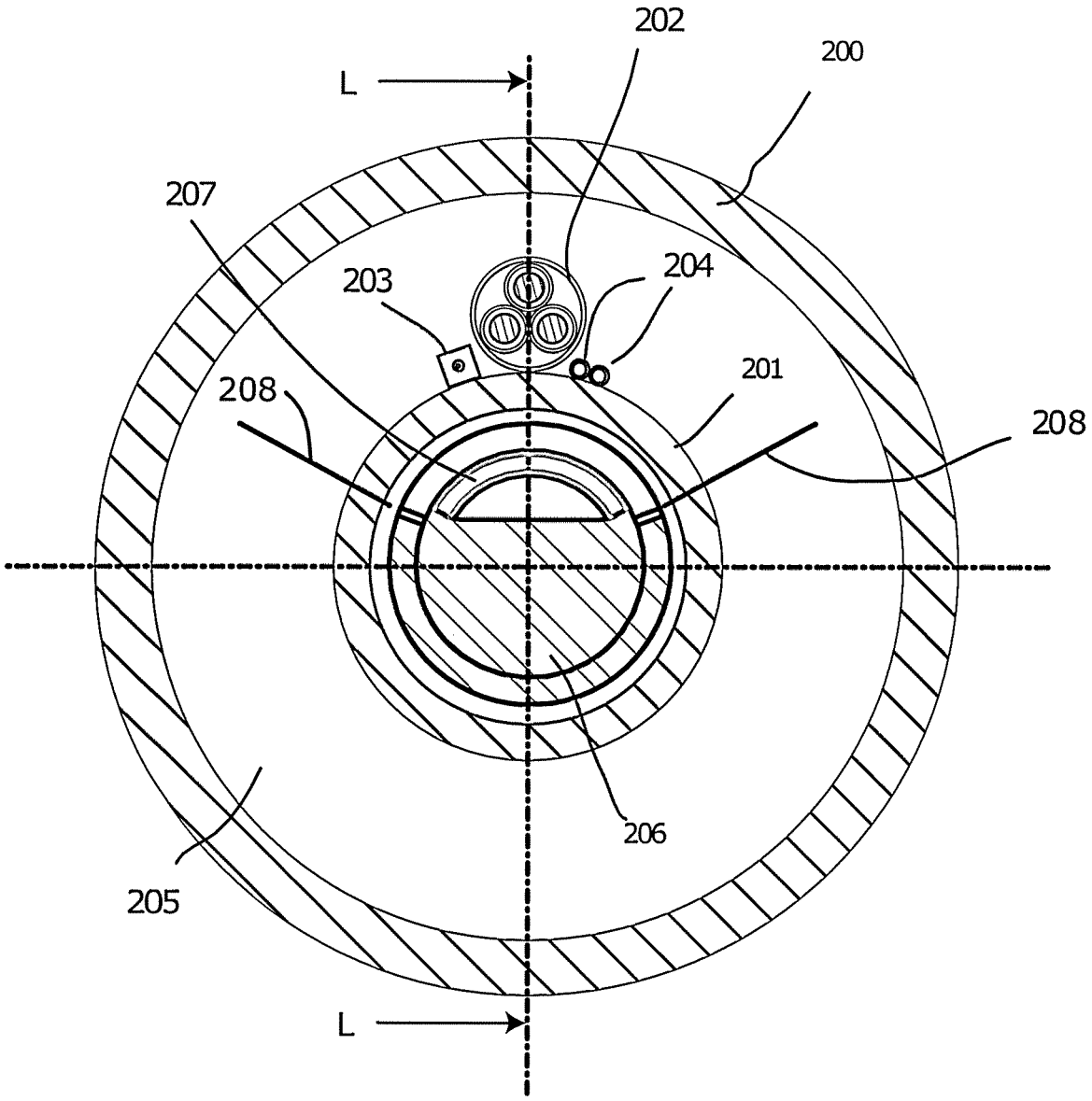
Figures 9, 10:
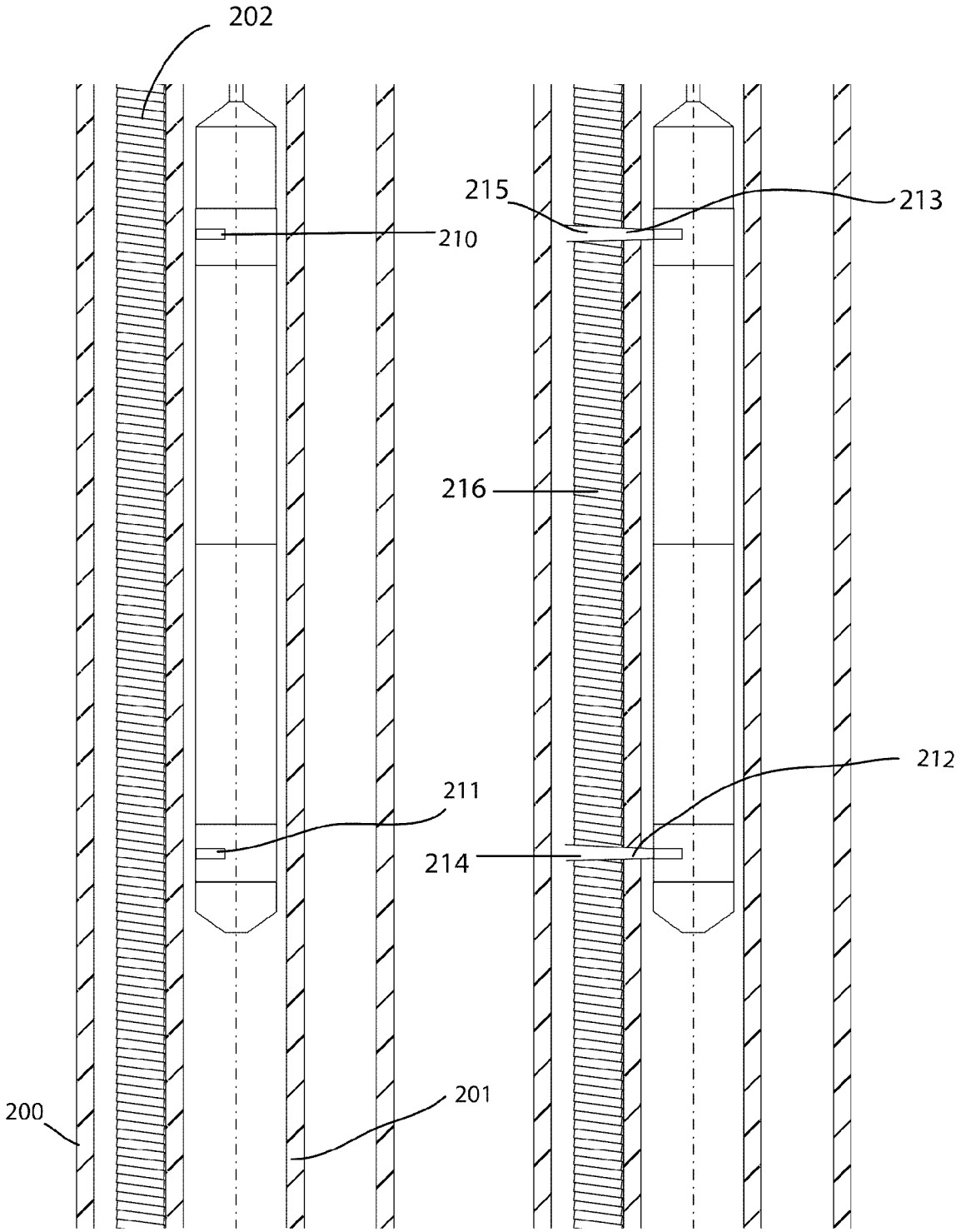
Figure 11:
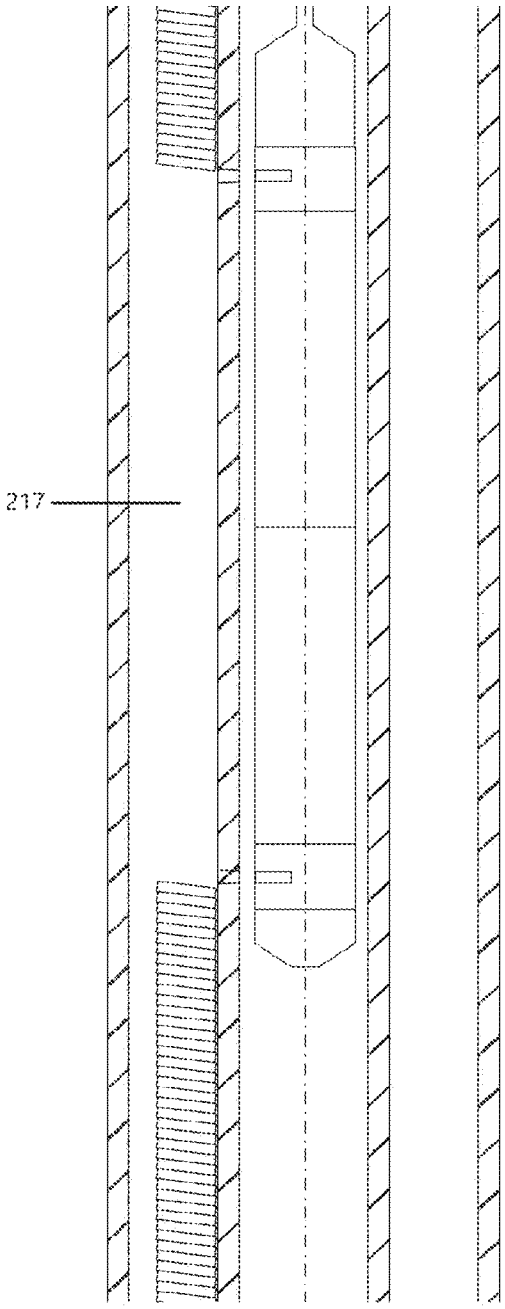
Figure 12:
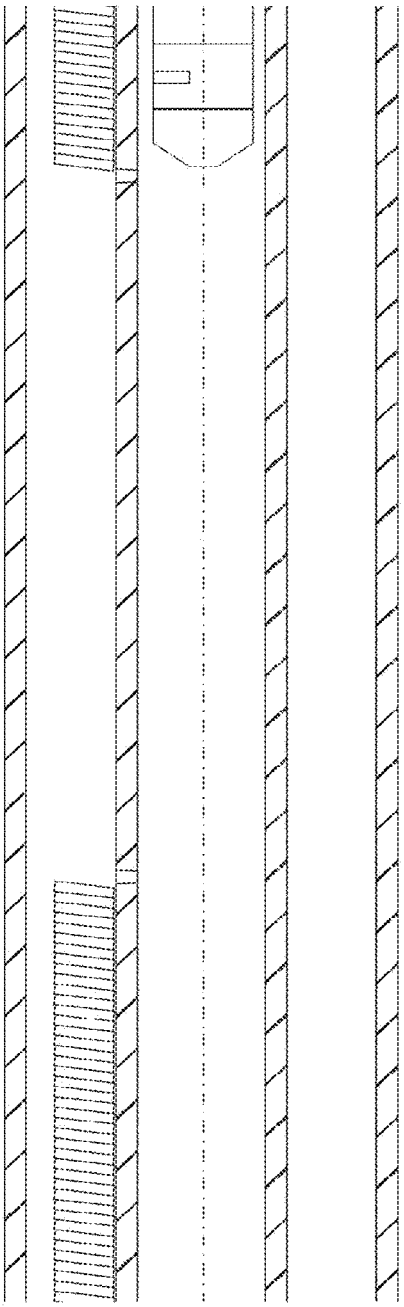
Figure 13:
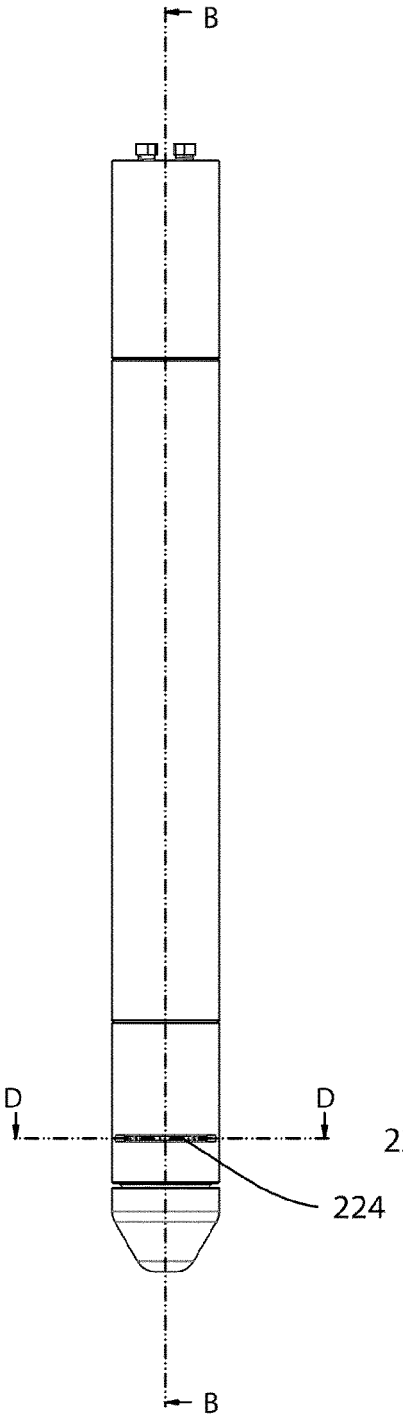
Figure 14:
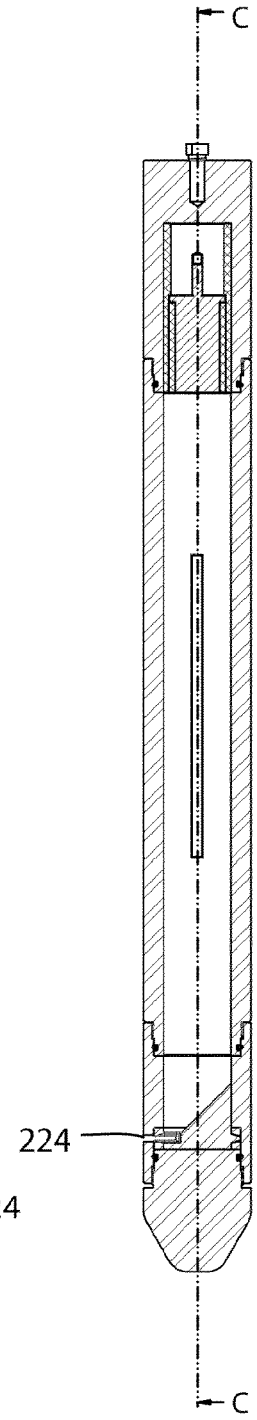

FIG. 8 is a section end view of a well show the well casing, the tubing, power cables and control lines strapped to the outside of the tubing inside the well and a directional slitting tool inside the tubing and orientated to align the slitting nozzle with the external strapped cables FIG. 9 is a section LL side view of the well shown in FIG. 8, with the slitting tool orientated to the external cables FIG. 10 is a similar view to FIG. 9 with the tool activated and both upper and lower jets discharging a plasma jet of thermite with slits the tubing and any externally strapped cables FIG. 11 is a similar view to FIG. 10, with the external cabling between the two slitting jets falling into the annular space FIG. 12 is a similar view to FIG. 11, with the plasma jet tool being removed from the well FIG. 13 is an external view of the tool, in the direction of the slitting nozzle FIG. 14 is a section BB view of the tool in FIG. 13

Figure 15:
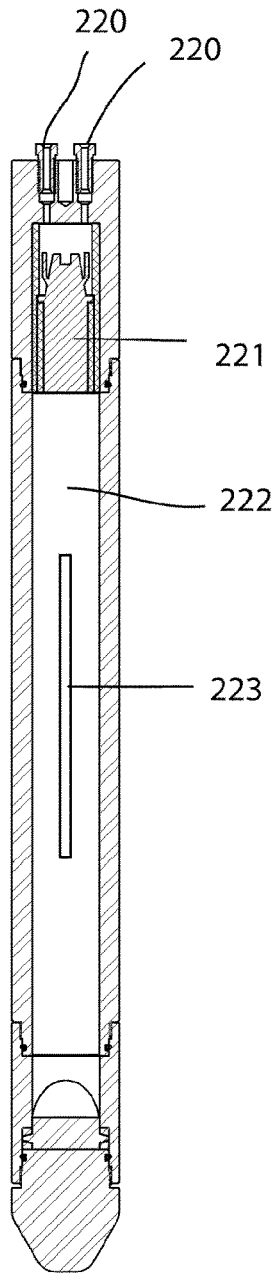

FIG. 15 is a section CC view of the tool in FIG. 14

Figure 16:
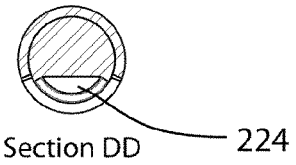

FIG. 16 is a section DD view of the tool in FIG. 13

Figure 17:
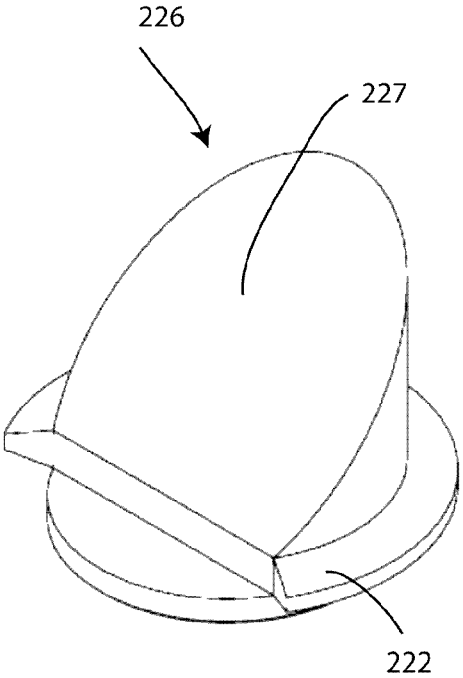

FIG. 17 is an isometric view of a spacer which holds the two faces of the discharge nozzle apart.

Figure 18:
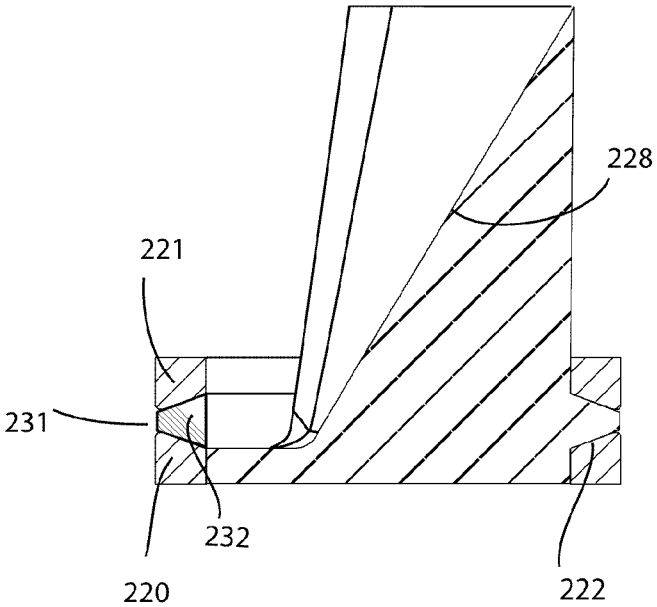
Figure 19:
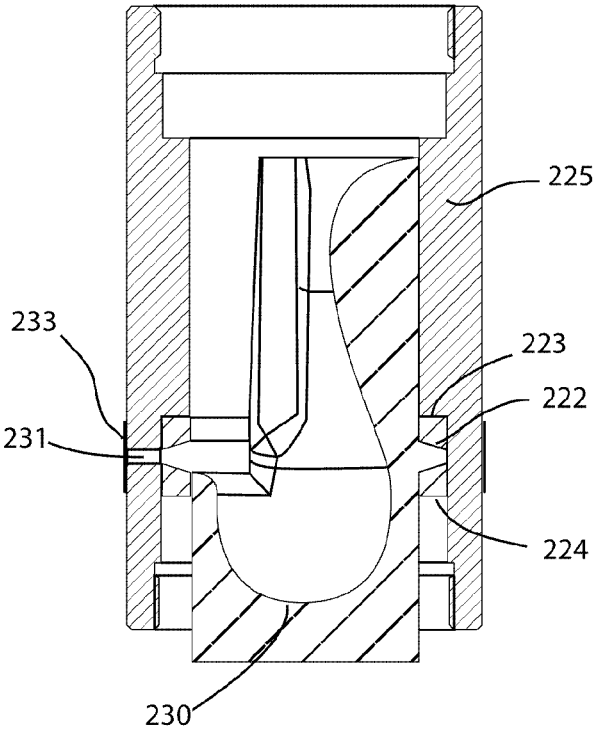

FIG. 18 is a side view of another embodiment of the spacer and two sides of the nozzle fitted FIG. 19 is a side view of another embodiment of the spacer and two sides of the nozzle fitted and inside the pressure housing.

Figure 20:
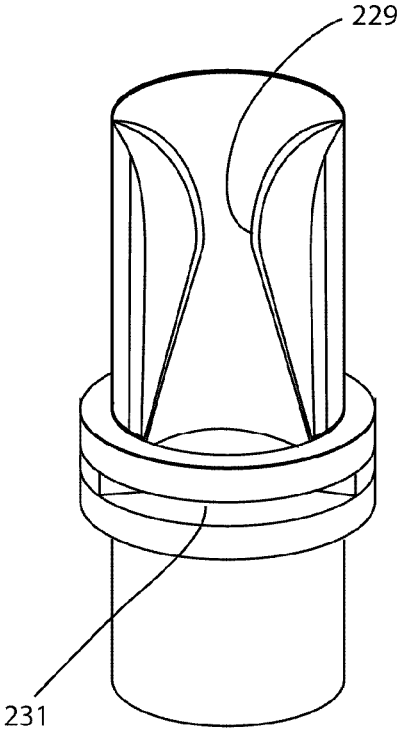

FIG. 20 is an isometric view of the nozzle shown in FIG. 18, which the high-pressure housing removed.

Figure 22:
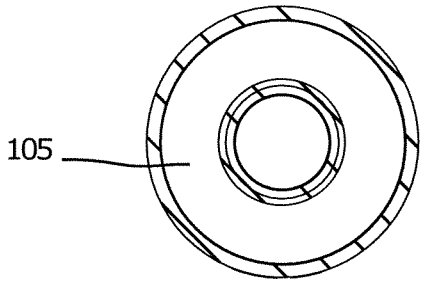
Figure 21:
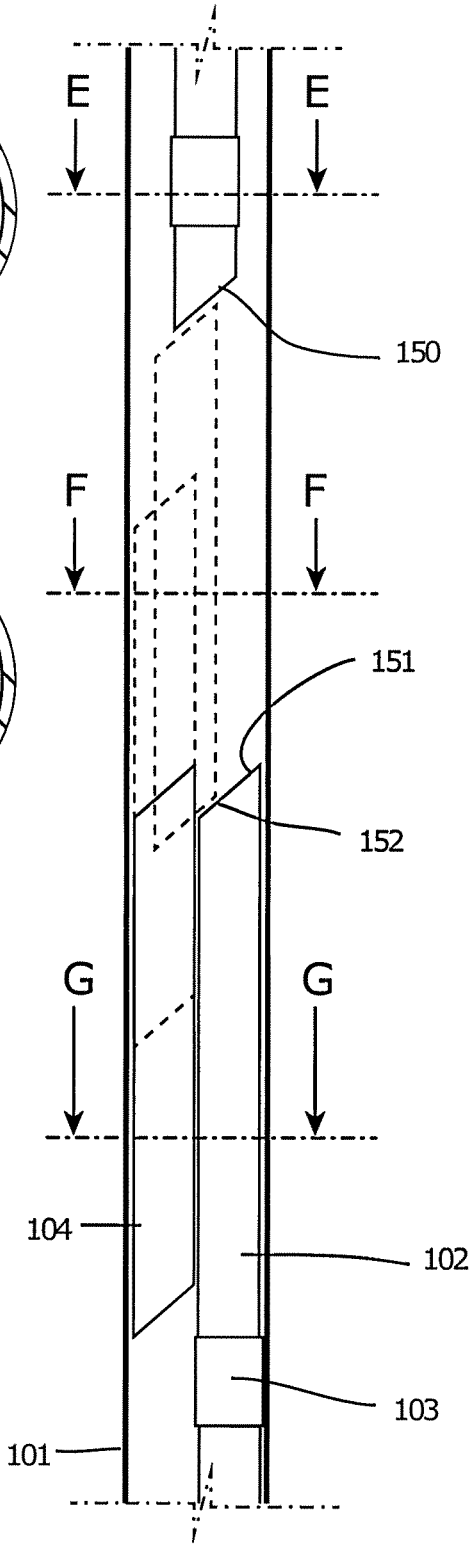

FIG. 21 is a section side view of a well with the tubing severed in two places at an angle of 45 degrees to the vertical FIG. 22 is a section EE end view of FIG. 21

Figure 23:
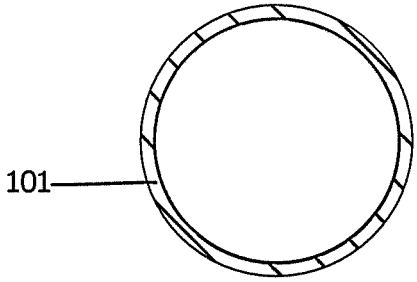

FIG. 23 is a section FF end view of FIG. 21

Figure 24:
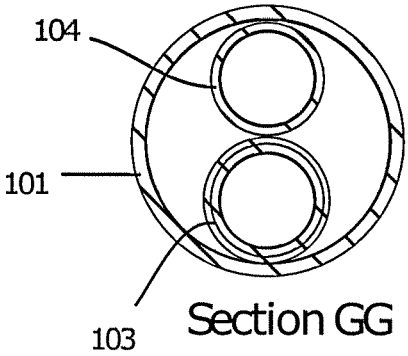

FIG. 24 is a section GG end view of FIG. 21

Figure 25:
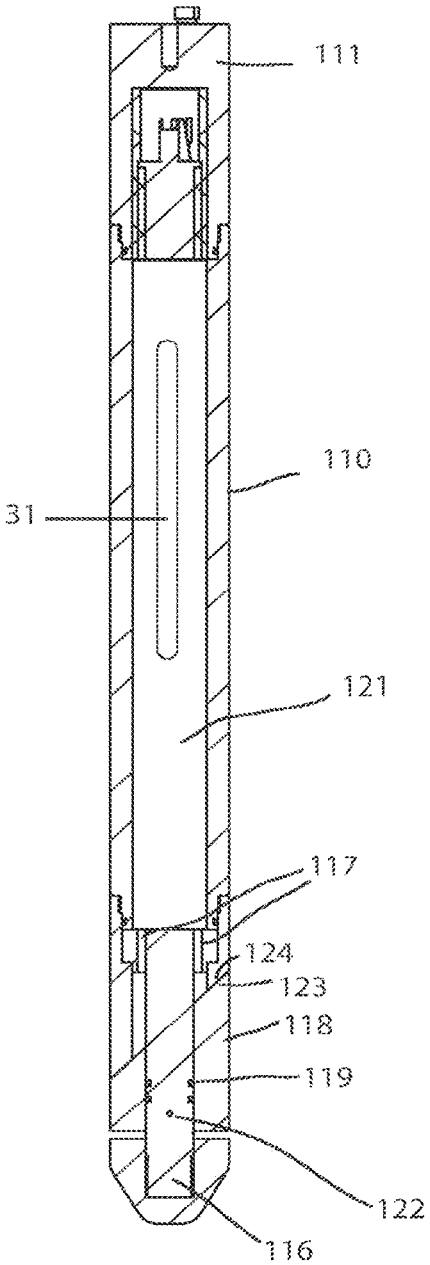
Figure 26:
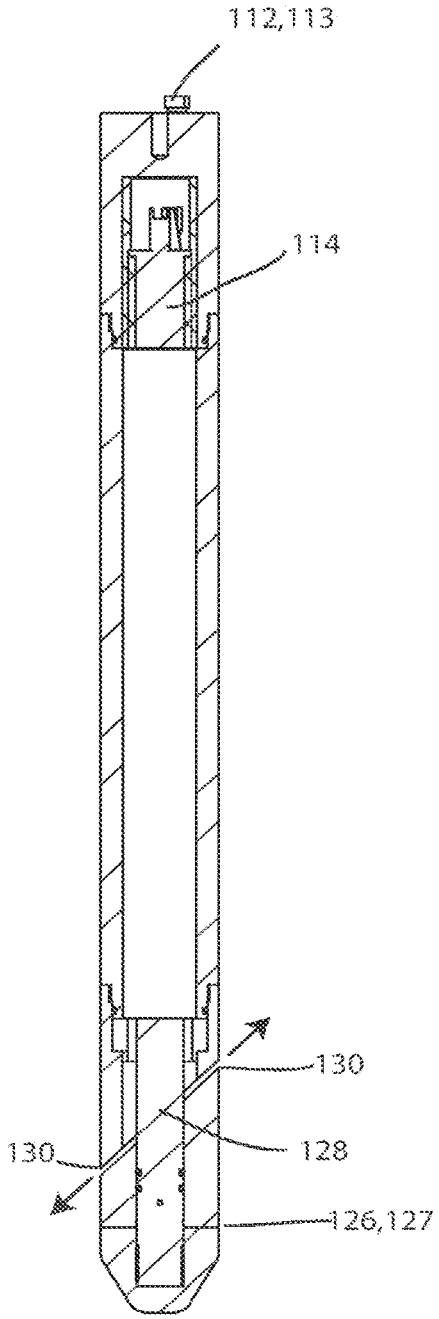
Figure 27:
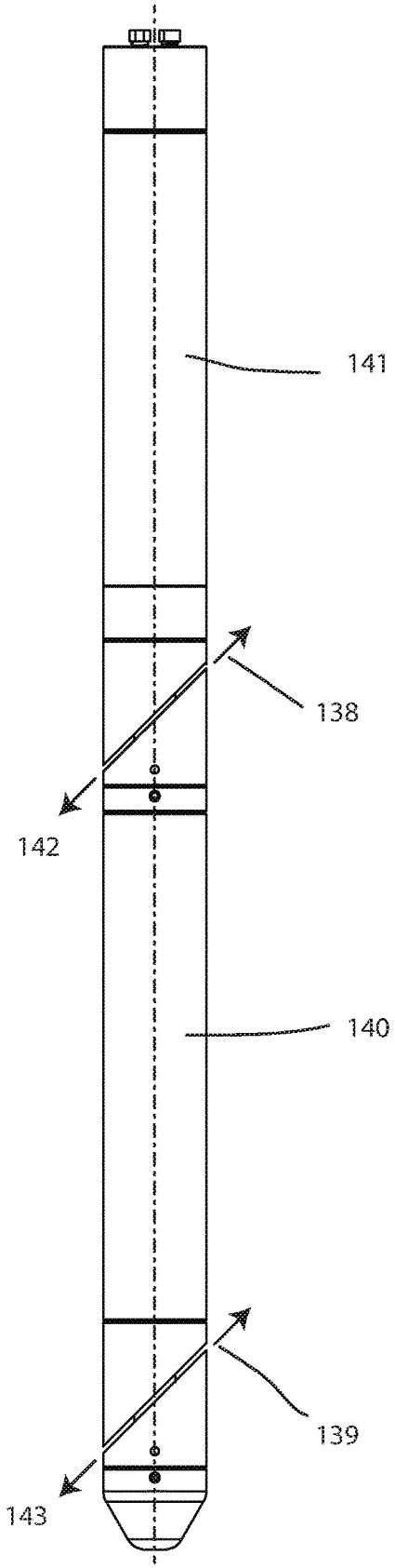
Figure 28:
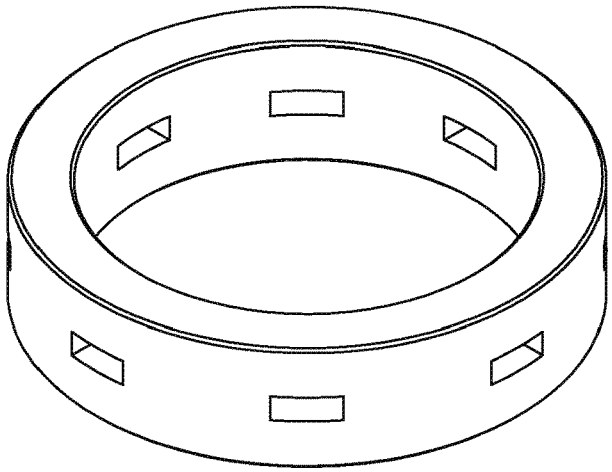

FIG. 25 is a section side view through one embodiment of the tool, before being activated FIG. 26 is a section side view through one embodiment of the tool, after being activated FIG. 27 is an external view of another embodiment of the invention FIG. 28 is an external view of a multiple orifice nozzle used to generate perforations Referring to FIGS. 1 to 7

There is shown a casing 1, and inside this is the production tubing 2. The tool 3 to be described in the subsequent figures has to be lowered inside the production tubing, and have sufficient clearance 4 to pass thought the tubing. When at the required depth where it is desired to separate the tubing, the tool is stopped. It running tool (not shown) conveying the assembly in the well talks to this tool acoustically, and it also includes a pressure sensor to only allow the tool to operate after it has reach a pre determine depth in the well Referring to FIGS. 2 to 5 there is shown an embodiment of the invention. It consists of a high-pressure housing 10 an upper cap 11 with cable feed thru's 12,13 which connect to the ignitor 14

At the lower end is the bottom cap 15, which retains a shaft 16 which has 8 drilled holes 17 which allow the energised thermite material to flow. Mounted on the lower end of the shaft is a cylindrical sleeve 18, with O ring 19, 20 providing a pressure barrier to the energised fluid which is created in the high-pressure cylinder chamber 21. At the upper end of the cylindrical sleeve 18 is an adaptor 23 which holds one half of a tungsten carbide nozzle 24, the other half of the nozzle 25 is retained in the lower end of the retaining sleeve 15. The distance these are set apart determine how wide the plasma jet. So the nozzle width can be adjusted to suit the thickness, and hardness of the material to be severed by adjusting the position of the lower end cap 26 and locking in this position by a grub screw 27. The combined angle of the faces of the nozzle facing each other is 30 degrees (15 degrees on each side), this accelerates the energised thermite through the nozzle gap 30'.

To provide a hermetic seal the discharge holes 17 could be sealed by a thin layer of bismuth 40, this melts rapidly, and is flushed out of the holes 17 with the thermite plasma. Alternatively, a heat shrink material 41 could cover the nozzle exit, again this keeps the thermite chamber hermetically sealed from the wellbore fluid.

The thermite composition stored in the chamber 21 includes an oxidizable metal, an oxidizing reagent, and a gas-producing additive selected from the group consisting of metal carbides and metal nitrides. The additives include the covalent carbides, such as silicon carbide and boron carbide, but may also include interstitial carbides, such as titanium carbide and vanadium carbide. In addition, nitrides of silicon and titanium may also be used in the composition.

The oxidizable metal is selected from the group consisting of AlSi, AlMg, Mg and aluminium, and is provided in the range from about 7.5% to about 35.5% by weight of the composition. The oxidizing reagent is selected from the group consisting of CuO, Cu2O, Cr2O3, WO3, Fe2O3, Fe3O4,MnO2 and PbO2, and is provided in the range from about 64.0% to about 92.0% by weight of the composition.

The additive that can be added to the composition in small quantities to enhance gas production is one of the group consisting of SiC, TiC, B4C and VC. Silicon nitride or titanium nitride can also be used for enhancing the gas production in the composition. The producing additive is provided in the range from about 0.5% to about 10% by weight of the composition.

The oxidizable metal used in the composition provides readily oxidizable fuel. The carbon component of the additive, when oxidized, yields the gaseous products, i.e., carbon monoxide and carbon dioxide, which contribute to the production of gas.

While the thermite mixture, that is stoichiometric with respect to the formulated redox reaction, is expected to be near thermal optimum, a range of compositions can be employed to achieve different results. A preferable thermite composition includes 79.5% CuO, 17.5% Al and 3% SiC. The fuel-oxidizer reagent ratio for a useful blend may vary from the preferable composition by 15% or more. For example, the preferred composition may be changed to a mixture that includes 77% CuO, 20% Al and 3% SiC.

In addition, a small hermetically seal container 31 is inside the thermite chamber. Inside the container 31, would be water, glycol, glycerine or other liquid, both glycol and glycerine are more suited to high temperature applications as they have a higher boiling temperature. When the thermite reaction is initiated, the liquid in the container is rapidly converted into an energised gas, which energises the thermite into a highly energised plasma jet, which severs the tubing outside it rapidly leaving an extremely clean cut.

Figure 1:
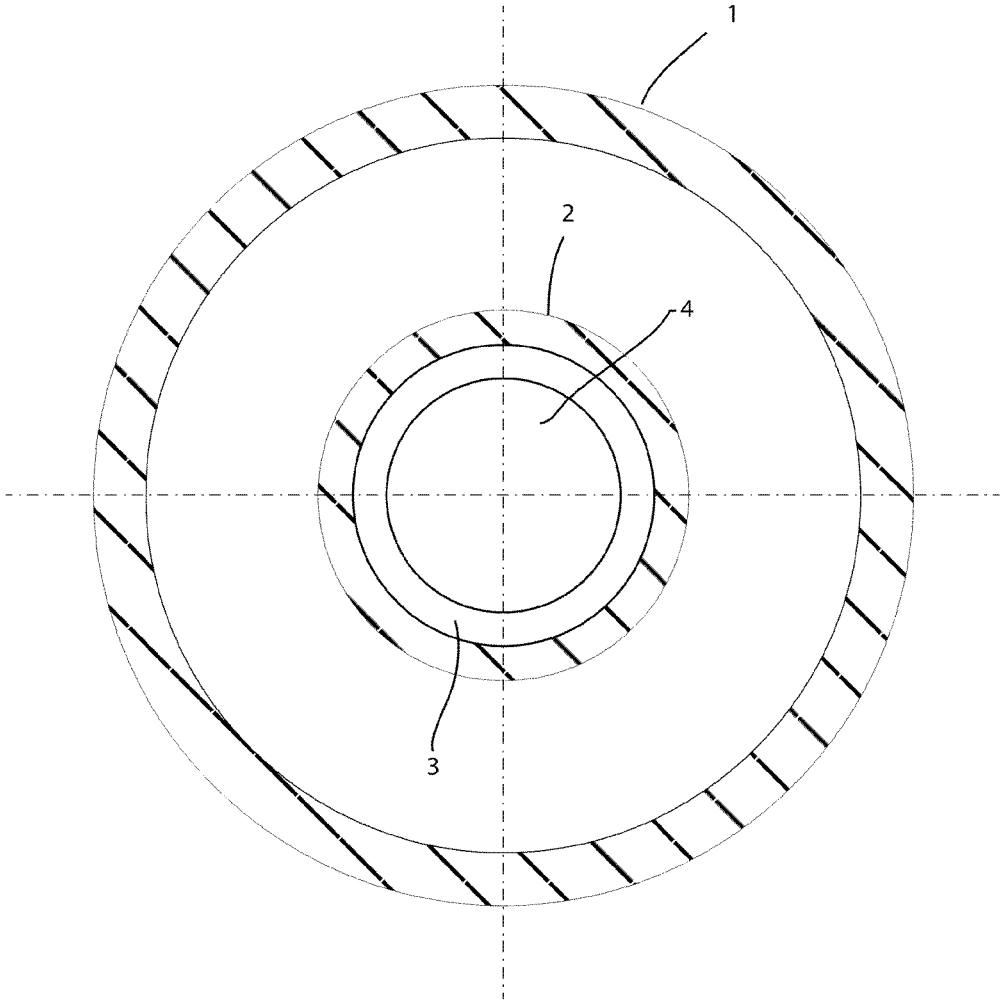
FIG. 1 is a section end view of a well show the well casing, the tubing inside the well and the severing tool inside the tubing.
Figure 2:
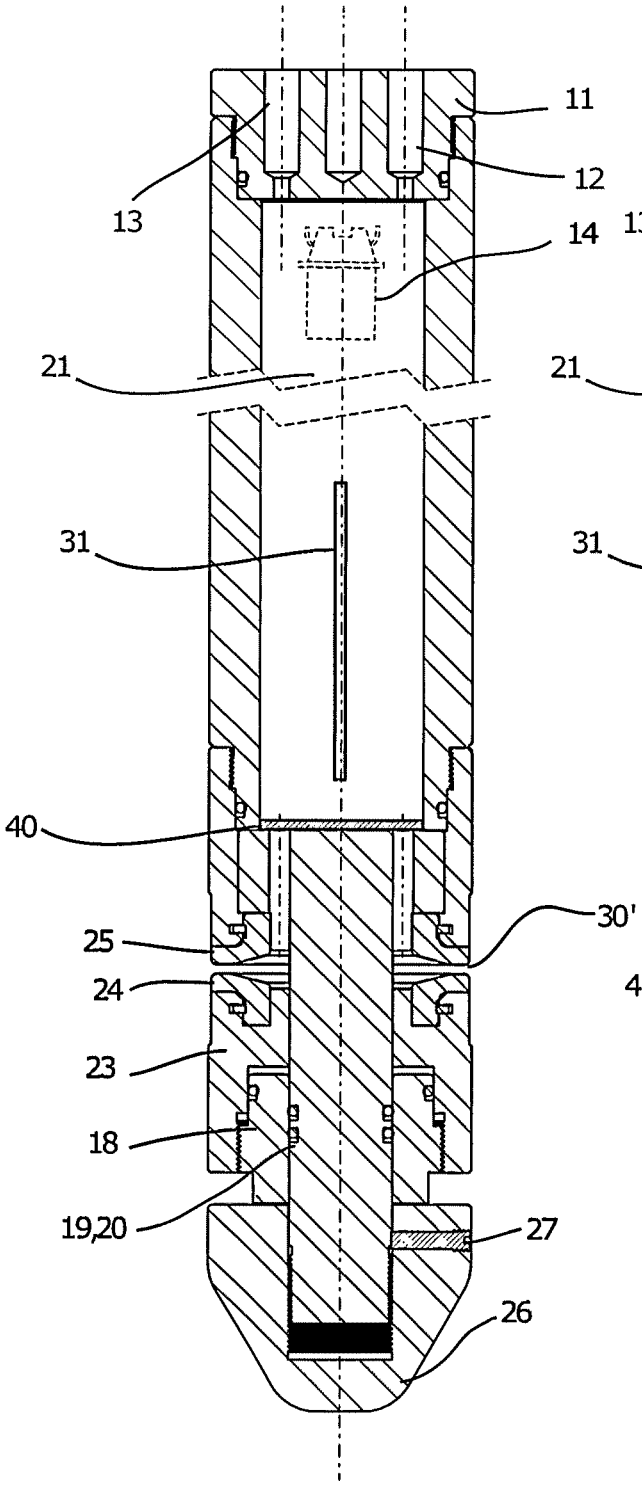
FIG. 2 is a section side view of one embodiment of the severing tool.
Figure 3:
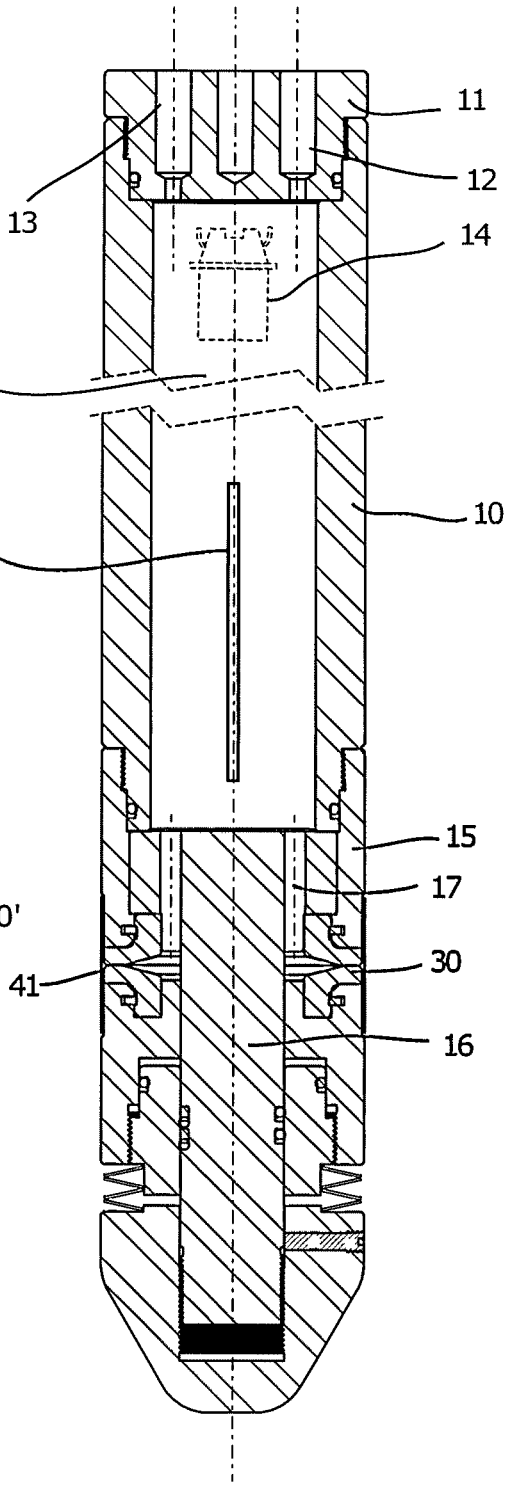
FIG. 3 is a section side view of another embodiment of the severing tool.
Figure 4:
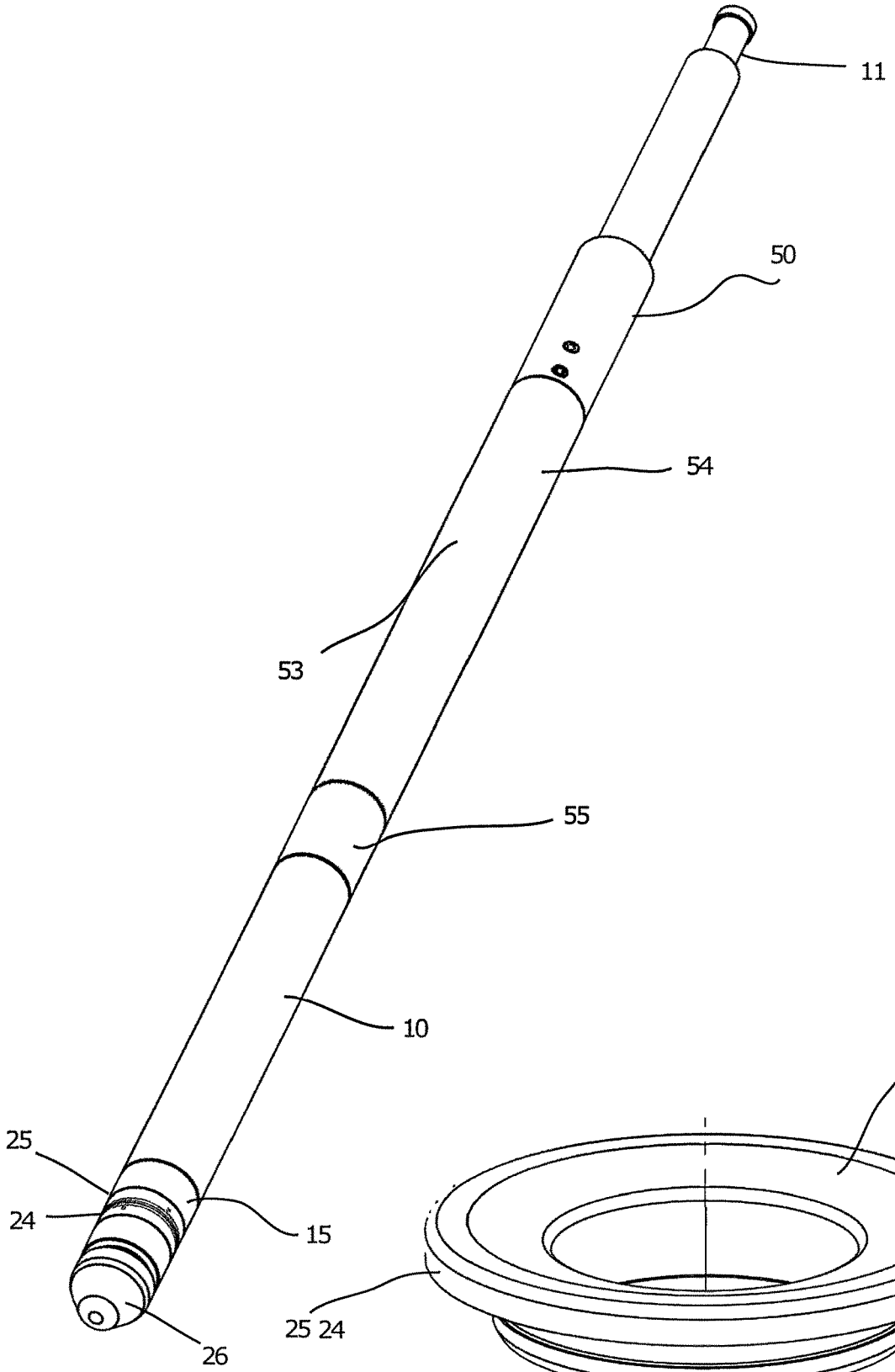
FIG. 4 is a isometric view of the tool disassembled
Figure 5:
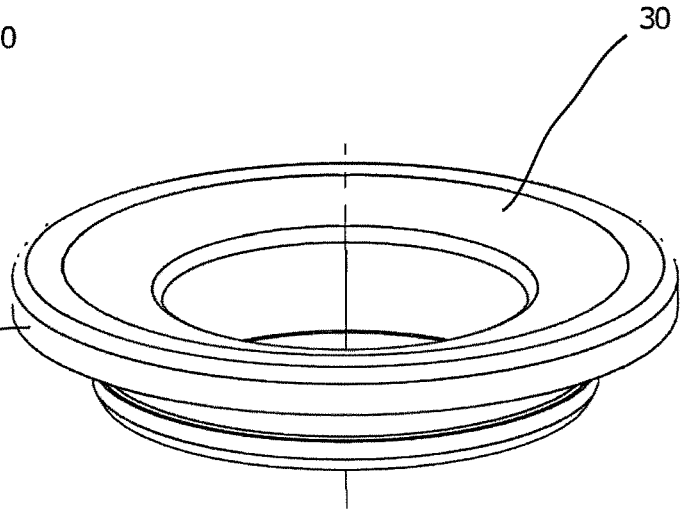
FIG. 5 is a isometric view of one half of the exit nozzle.
Figure 6:
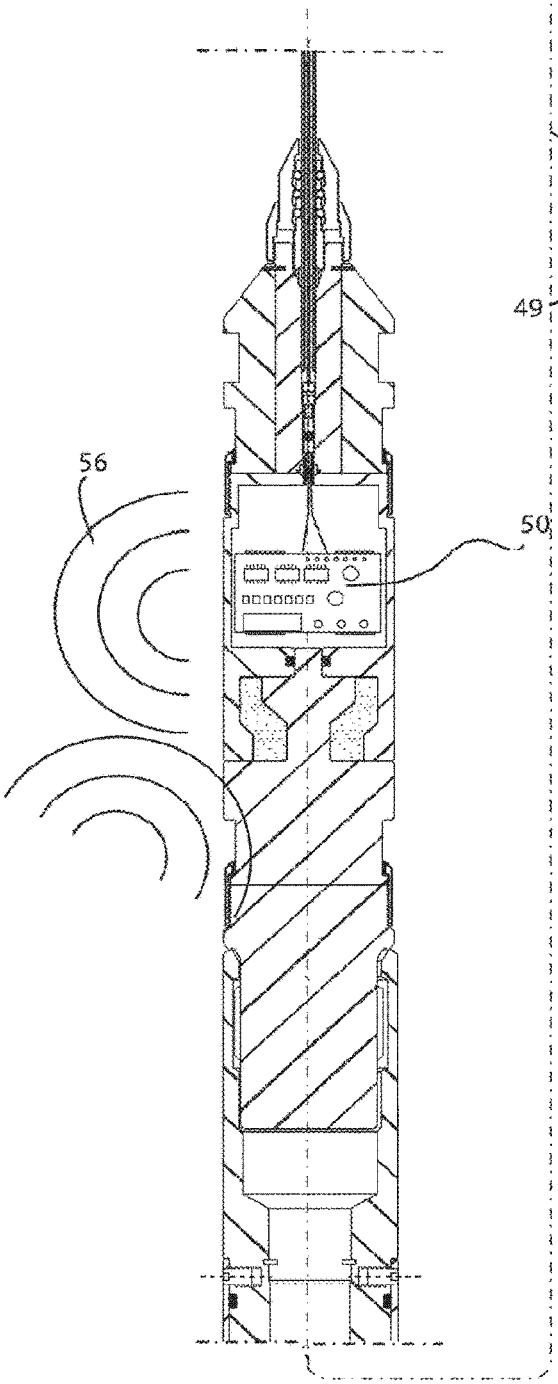
FIG. 6 is a section side view through the upper half of one embodiment of the invention
Figure 7:
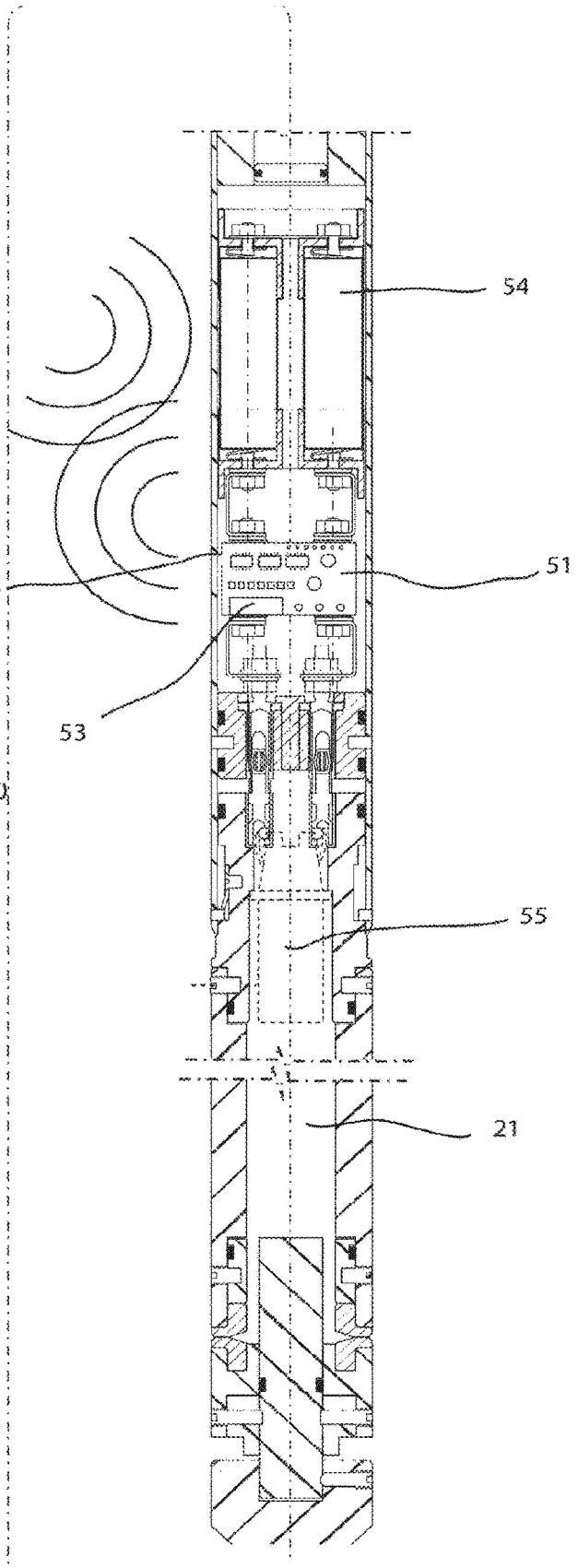
FIG. 7 is a section side view through the lower half of the embodiment of the invention shown in FIG. 6

Referring to FIGS. 6 to 7 there is shown the upper end of the tool which includes an acoustic transmitter/receiver for providing ultra-safe ignition commands to the thermite ignitor At power-up, each pc card 48, 49 checks a jumper to determine if it's the Master 50 or the Slave 51. Master is the one that sends the commands, Slaves are the receivers and the ones that initiate the burn.

There are four operating modes: standby, ready, arm, and fire.

The goal is for safety and security, the receiver must receive the proper commands in the proper sequence in order to initiate the burn.

When the Master is told to transmit from a surface signal, it waits for its time slot, transmits an acoustic signal 56, then pauses for the duration of a time slot to allow any slave unit to communicate back acoustically.

The Receiver (slave) initially does nothing. It waits for the pressure switch safety interlock to activate. Once that happens, it goes to receive mode, in the standby mode to start. It turns on its receiver and waits for commands.

It will receive anything it hears, but it is looking for specific commands and a preamble and post amble (framing bytes). If all of that doesn't line up, it ignores the transmission.

So first the Ready command is sent, and both boards transition. Then "arm", then "fire". On Fire, the relay 53 latches on, and applies power which comes from 3×4.4 volt 30 amp batteries 54 in series to the initiator 55 and the burn starts The entire assembly can be recovered to surface, but in the event of getting stuck there are several forms of release to enable the wireline to be recovered.

Referring to FIGS. 8-to 20

There is shown a section plan view of a well, with casing 200, production tubing 201, banded or clamped to the outside of the tubing 201 is an ESP power cable 202, instrumentation cable 203 and hydraulic control lines 204.

Generally, these have to be removed before an acceptable long term seal can be placed in the annular space 205.

Inside the tubing is a thermite plasma jet slitting tool 206, which has a tungsten carbide nozzle 207 with a 120 degree exit angle 208 orientated to be facing the direction were all the external cabling and control lines are run. The orientation method has not been shown but would include a sensing mechanism to detect the excess copper and steel, and a stepper motor to index the tool 206 relative the tubing 201. The power of the jet would also move the severed section of cable 216 into the free annular space where it would fall leaving a clear annular spaced 217 to be filled with sealing material, this could be repeated in multiple places in the well.

The tool itself is a similar construction to the severing tool. It is connected to a running tool not shown, wires from a battery pack pass through a bulk head 220 and connect to an ignitor cartridge 221. When the ignitor is initiated, the retarded thermite 222 in the chamber reacts rapidly and rises to a temperature of 1400 C rapidly, inside a hermetically sealed plastic tube 223 is a volume of glycerine or glycol, at the thermite temperature, the liquid is quickly converted to gas and provides the energy to create a very powerful plasma jet which exits the tool via the nozzle 224

The tool would fire two nozzles 210, 211 simultaneously, these would project a plasma jet in a 120 degree arc, and severing anything in its path, in this case it would skit the tubing 212, 213 and any cabling 214, 215 in the annulus At the lower end of each tool module, is an exit nozzle. This consists of two tungsten carbide rings 223,224 which have a tapered exit angle which is inclusive 30 degrees, and are held apart by the required separation by a tapered shoulder 222 and retained in a bore of the pressure housing 225, against faces 223,224.

The nozzle has no restrictions 231 across its opening, and can be as wide as required, in this example the nozzle exit area has an arc of 120 degrees.

The spacer 226 holding the tungsten carbide rings apart can be shaped to assist the flow of the energised thermite through the nozzle, it could consist of a simple taper 227, a concave curved surface 228, a venturi choke 229, or a cavitation bowl 230

The nozzle exit could be sealed using a thin wafer of bismuth 232 which would rapidly melt and exit the nozzle, or a high temperature water proof tape 233

Referring to FIGS. 21 to 27

There is shown a casing 101, and inside this is the production tubing 102. Which is joined together by couplings 103. A length of tubing is typically 30 ft long, FIG. 21 shows the main concept of the invention, which is to sever the tubing in two places 150, 151, with the sever cut at an angle to the vertical 152 such that gravity and the force of the cutting action will cause the portion of tubing severed 104 to fall into the annular space 105

Referring to FIGS. 25 to 27 there is shown an embodiment of the invention. It consists of a main housing 110 an upper cap 111 with cable feed thru's 112,113 which connect to the ignitor 114

At the lower end is the bottom cap 115, which retains a shaft 116 which has a number of drilled holes 117 which allow the energised thermite material to flow. Mounted on the lower end of the shaft is a cylindrical sleeve 118, with O ring 119, 120 providing a pressure barrier to the energised fluid which is created in the high pressure cylinder chamber 121. The sleeve 118 is shear pinned 122 to the shaft 116. At the upper end of the cylindrical sleeve 118 is an adaptor 123 which holds one half of a tungsten carbide nozzle 124, the other half of the nozzle 125 is retained in the lower end of the retaining sleeve 115. When the shear pin fails, the faces 126 and 127 come together, and the distance these are set apart determine how wide the nozzles separate. So the nozzle width can be adjusted to suit the thickness, and hardness of the material to be severed. The angle of the faces of the nozzle is set at 45 degrees 128 to the axis of the tubing, the energised thermite through the nozzle gap 130.

The thermite composition stored in the chamber 121 includes an oxidizable metal, an oxidizing reagent, and a gas-producing additive selected from the group consisting of metal carbides and metal nitrides. The additives include the covalent carbides, such as silicon carbide and boron carbide, but may also include interstitial carbides, such as titanium carbide and vanadium carbide.

In addition, nitrides of silicon and titanium may also be used in the composition.

The oxidizable metal is selected from the group consisting of AlSi, AlMg, Mg and aluminium, and is provided in the range from about 7.5% to about 35.5% by weight of the composition. The oxidizing reagent is selected from the group consisting of CuO, Cu20, Cr2O3, WO3, Fe2O3, Fe3O4,MnO2 and PbO2, and is provided in the range from about 64.0% to about 92.0% by weight of the composition.

The additive that can be added to the composition in small quantities to enhance gas production is one of the group consisting of SiC, TiC, B4C and VC. Silicon nitride or titanium nitride can also be used for enhancing the gas production in the composition. The producing additive is provided in the range from about 0.5% to about 10% by weight of the composition.

The oxidizable metal used in the composition provides readily oxidizable fuel. The carbon component of the additive, when oxidized, yields the gaseous products, i.e., carbon monoxide and carbon dioxide, which contribute to the production of gas.

While the thermite mixture, that is stoichiometric with respect to the formulated redox reaction, is expected to be near thermal optimum, a range of compositions can be employed to achieve different results. A preferable thermite composition includes 79.5% CuO, 17.5% Al and 3% SiC. The fuel-oxidizer reagent ratio for a useful blend may vary from the preferable composition by 15% or more. For example, the preferred composition may be changed to a mixture that includes 77% CuO, 20% Al and 3% SiC.

In addition, a small hermetically seal container 31 is inside the thermite chamber. Inside the container 31, would be a liquid such as water, glycol, glycerine, both glycol and glycerine are more suited to high temperature applications as they have a higher boiling temperature. When the thermite reaction is initiated, the liquid in the container is rapidly converted into an energised gas, which energises the thermite into a highly energised plasma jet, which severs the tubing outside it rapidly and leaves an extremely clean cut.

In a single trip it will be advantageous to sever the tubing in two places 138, 139.

This would consist of a tool with two independent thermite chambers 140,141 which would supply energised thermite plasma to two independent exit nozzles 142,143

Thus in a single well intervention a section of tubing can be severed to create a window to access the casing outside it.

The entire assembly can be recovered to surface, but in the event of getting stuck there are several forms of release to enable the wireline to be recovered.

FIG. 28 shows a single piece tungsten nozzle with 8 exit nozzles, all the nozzles use a hard material such as tungsten carbide, which have a high resistance to wear, enabling the nozzle to maintain a highly energised plasma jet.

The example shown in FIG. 28 would generate 8 perforations.

The invention claimed is:

1. A well cutting tool, comprising;

a housing including a chamber;

the housing having at least one nozzle;

the chamber being loaded with thermite, and a gas-generating additive; and an ignitor;

such that when the ignitor is actuated to ignite the thermite, the gas-generating additive is caused to create an increase in pressure which discharges energised molten thermite from the chamber and out of the housing through the at least one nozzle, wherein there is provided a volume of liquid in a hermetically sealed container inside the thermite chamber, such that when the thermite is heated, it converts the liquid to a highly energised state which results in a highly energised plasma jet which discharges with the energised molten thermite.

2. A tool according to claim 1, wherein the liquid includes a gycol, glycerine, or water.

3. A tool according to claim 1, wherein the nozzle includes a face or faces which direct the energised molten thermite, and the nozzle face or faces can be adjusted to open to different widths depending upon the thickness of any tubing to be severed.

4. A tool according to claim 1, wherein the at least one nozzle comprises more than one nozzle to produce multiple perforations.

5. A tool according to claim 4, wherein the nozzles separate to form a shape so as to focus a discharge jet in a thin controlled 360 degree dispersion and inclined at an angle 45 degrees to an axis of the tubing.

6. A tool according to claim 1, wherein the at least one nozzle is formed from two nozzle rings with a spacer between the nozzle rings to separate the nozzle rings.

7. A tool according to claim 6, wherein the spacer is shaped to focus the discharge.

8. A tool according to claim 1, wherein the at least one nozzle is a single piece component made from tungsten carbide.

9. A tool according to claim 1, wherein the at least one nozzle comprises two solid tungsten carbide rings, which when separated generate a uniform 360 degree plasma jet.

10. A tool according to claim 1, wherein the gas generating additive includes covalent carbides, including one of silicon carbide and boron carbide, and/or interstitial carbides, including one of titanium carbide and vanadium carbide.

11. A tool according to claim 1, wherein an electrical ignitor initiates a thermal ignitor when it receives a coded acoustic signal from a transmitting tool.

12. A tool according to claim 1, wherein an ignitor is electrically actuated and initiates a thermal ignitor when it receives an instruction on a conveyed wireline.

13. A tool according to claim 1, wherein the at least one nozzle is covered by heat shrink material.

14. A tool according to claim 1, wherein the at least one nozzle is sealed with bismuth, which melts and allows a plasma to flow out of the nozzle.

15. A tool according to claim 1, wherein the at least one nozzle is sealed with water proof tape, which tears open when the thermite is ignited.

16. A tool according to claim 1, wherein a secondary back up including a hydrostatic pressure switch is provided to actuate the tool.

17. A well cutting tool, comprising;

a housing including a chamber;

the housing having at least two nozzles;

the chamber being loaded with thermite, and a gas-generating additive; and an ignitor;

such that when the ignitor is actuated to ignite the thermite, the gas-generating additive is caused to create an increase in pressure which discharges energised molten thermite from the chamber and out of the housing through the nozzles;

wherein the nozzles separate to form a shape to focus a discharge jet in a thin controlled 360 degree dispersion and inclined at an angle 45 degrees to an axis of associated tubing in which the housing is adapted to be located.

* * * * *